US005824941A

United States Patent [19]

Knäpper

[11] Patent Number: 5,824,941

[45] Date of Patent: Oct. 20, 1998

[54] ARRANGEMENT FOR PROTECTION FROM PROJECTILES

[75] Inventor: Stefan Knäpper, Lauf, Germany

[73] Assignee: Diehl Stiftung & Co., Nuremberg, Germany

[21] Appl. No.: 332,496

[22] Filed: Apr. 3, 1989

[30] Foreign Application Priority Data

Apr. 9, 1988 [DE] Germany ..... P 38 11 878.5

[51] Int. Cl.[6] ..... F41H 5/007

[52] U.S. Cl. ..... 89/36.17; 89/36.08

[58] Field of Search ..... 89/36.17, 36.08; 109/49.5, 36, 37; 428/911

[56] References Cited

U.S. PATENT DOCUMENTS

| | | | |
|---|---|---|---|
| 95,059 | 9/1869 | White | 109/37 |
| 971,900 | 10/1910 | Klett | 109/36 |
| 3,000,772 | 9/1961 | Lunn | 428/911 |

FOREIGN PATENT DOCUMENTS

| | | | |
|---|---|---|---|
| 2380528 | 9/1978 | France | 89/36.17 |
| 2008156 | 2/1970 | Germany | 89/36.17 |
| 2223353 | 11/1972 | Germany | 428/911 |
| 2191276 | 12/1987 | United Kingdom | 89/36.17 |
| 2192697 | 1/1988 | United Kingdom | 89/36.17 |
| 8705994 | 10/1987 | WIPO | 89/36.17 |

*Primary Examiner*—Stephen M. Johnson
*Attorney, Agent, or Firm*—Scully, Scott, Murphy & Presser

[57] ABSTRACT

An arrangement for protection from attack by projectiles, especially from hollow-charge projectiles or the like, consisting of a wall which is constituted of explosives and is arranged obliquely relative to the firing direction below a wall facing towards the projectile and which is constituted from an inert material. A foil consisting of an explosive for the formation of a reactive sandwiched or composite armoring is equipped with a steel plate on one side thereof and with a glass plate or a glass fiber-reinforced plastic material plate on its other side, wherein the composite armorings form chambers within a box structure such that, within any one chamber, a steel plate is always located opposite a glass plate, and the collective foils of explosive are connected along their bottom sides with a transmission or transfer foil which is similarly constituted from an explosive.

8 Claims, 1 Drawing Sheet

ARRANGEMENT FOR PROTECTION FROM PROJECTILES

BACKGROUND OF THE INVENTION

1. Field of the Invention

The present invention relates to an arrangement for protection from attack by projectiles, especially from hollow-charge projectiles or the like, consisting of a wall which is constituted of explosives and is arranged obliquely relative to the firing direction below a wall facing towards the projectile and which is constituted from an inert material.

2. Discussion of the Prior Art

An arrangement for protection from projectiles, especially from hollow-charge projectiles, is known from the disclosure of German Patent 20 08 156. A wall constituted from explosives, which is arranged obliquely relative to the firing direction, possesses layers consisting of an inert material on both sides thereof. In response to the jet from a hollow charge acting against the protective arrangement, the explosive will detonate. As a result thereof, the wall which is constituted from an inert material and which faces towards the jet from the hollow charge jet is continually displaced into the hollow charge, whereupon the jet from the hollow charge will be dissipated. This protective device fails to provide the necessary period of effectiveness against two-jet hollow charges in which two jets are produced at a spacing coaxially in sequence behind each other.

SUMMARY OF THE INVENTION

Accordingly, it is an object of the present invention to provide an arrangement for protection from projectiles, especially from hollow-charge projectiles or the like, which allows for a defense against the jets from hollow charges over a relatively lengthy period of effectiveness.

The present invention achieves the foregoing object through an arrangement for protection from projectiles of the type under consideration herein, in that a foil consisting of an explosive for the formation of a reactive sandwiched or composite armoring is equipped with a steel plate on one side thereof and with a glass plate or a glass fiber-reinforced plastic material plate on its other side, wherein the composite armorings form chambers within a box structure such that, within any one chamber, a steel plate is always located opposite a glass plate, and the collective foils of explosive are connected along their bottom sides with a transmission or transfer foil which is similarly constituted from an explosive.

BRIEF DESCRIPTION OF THE DRAWINGS

Advantageous modifications and further features of the invention can now be readily ascertained from the following detailed description of a preferred embodiment thereof, taken in conjunction with the accompanying drawings; in which.

DETAILED DESCRIPTION

Figure 1:
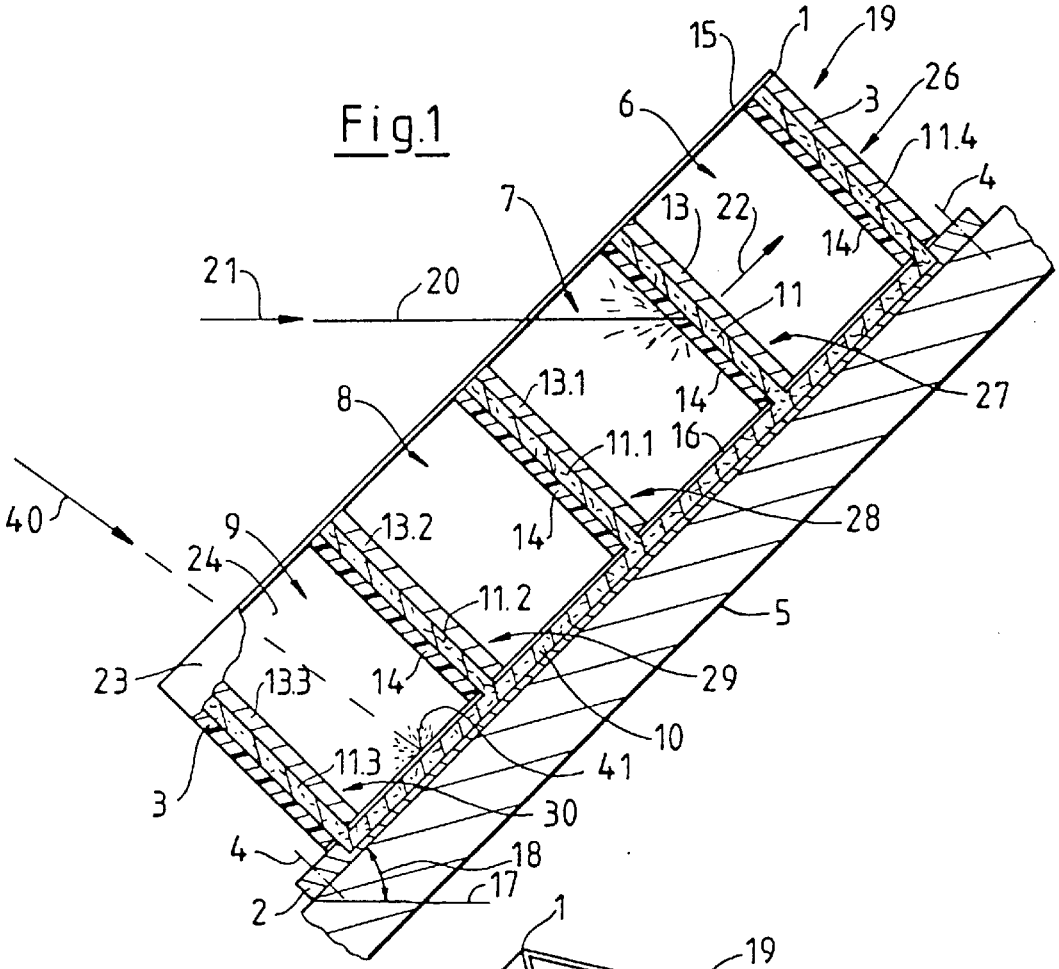
FIG. 1 illustrates a transverse sectional view through a protective arrangement which is mounted on a main armoring.
Figure 2:
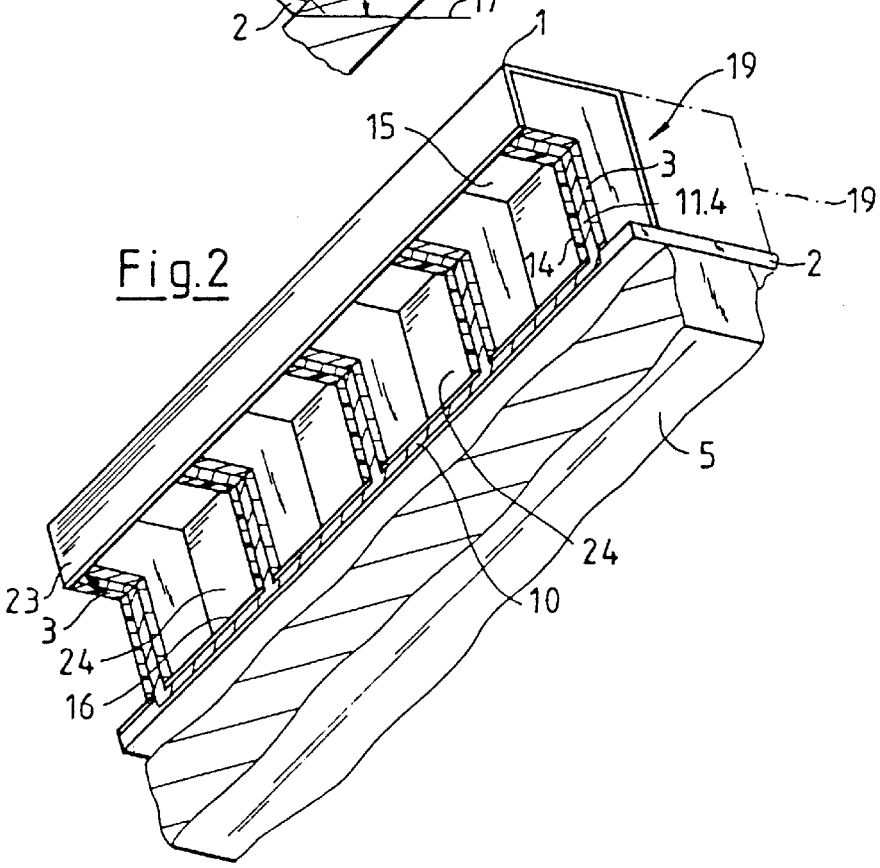
FIG. 2 illustrates, in partial section, a perspective view of FIG. 1.

Pursuant to FIG. 1 of the drawings, a protective arrangement 19 which is formed as a caisson or box structure 1 with chambers 6 through 9, including a bottom 2 and side plates

3 constituted of steel. The caisson box structure 1 subtends an angle 18 with the horizontal 17. The bottom 2 possesses fastening bores 4 for the attachment thereof on a main armoring 5 of a vehicle. In the bottom 2 there is positioned a foil consisting of an explosive, referred to as a transmission or transfer foil 10. At right angles thereto, foils 11 consisting of explosives stand on the transfer foil 10. The transfer foil 10 is covered in a surface-covering manner up to the connecting locations between the explosives foils 11 and the transfer foil 10 with a thin sheet 16 consisting of either steel or aluminum. Arranged alternatingly at both sides of the explosives foil 11 are steel plates 13 through 13.3 and glass plates and, as a result thereof, there are produced reactive composite or sandwiched armorings 26 through 30. Instead of the glass plates 14 it is also possible to utilize fiberglass-reinforced plastic plates. Thin cover and side plates are designed with reference numerals 15, 23 and 24.

A hollow-charge jet 20, in accordance with the arrow 21, penetrates through the cover plate 15, the glass plate 14 of the chamber 7 and triggers the explosives foil 11 of the composite armoring 27. The steel plate 13 of the chamber 6 is accelerated in the direction of arrow 22 in parallel with its initial position, and flies at a delay in time into the outgoing hollow-charge jet 20. The glass plate 14 of the chamber 7 forms the expellant for the steel plate 13 which is to be accelerated; it disintegrates into dust and disturbs the hollow-charge jet 20 only to a minor extent.

However, it is important that the glass plate 14, at a suitable design of its mass, does not exert any action against the neighboring steel plate 13.1 of the chamber 7. In essence, the latter is triggered by the explosive foil 11.1 which is associated therewith, whereby the detonation is effected by means of the transfer foil 10 which lies in surface contact in the bottom plate 2. Thereby, the steel plate 13.1 flies at a somewhat more extensive delay in time than does the steel plate 13 in the oncoming jet from the hollow charge 20. The remaining chambers 8 and 9 are similarly detonated so that their steel plates 13.2 and 13.3 will act against the oncoming portion of the hollow-charge jet. The latter is thereby no longer in a position to be able to weaken the main armoring 5.

The transfer foil 10, which encompasses the entire bottom area of the protective arrangement 19, does not effect a punctilinear, but an almost linear detonation of the explosives foil 11 through 11.4. This assists in enabling the steel plates 13 through 13.3 and the upper steel plate 3 to be accelerated substantially in parallel with their initial position and in a controllable manner. The hollow-charge jet 20 is thereby decimated to a maximum extent, in that there is available the largest possible usable material cross-section of the respective steel plates 3, 13 through 13.3.

For a hollow-charge jet 40 which is incoming somewhat in parallel with two composite armorings 29 and 30, there is also afforded the action of the protective arrangement 19. The hollow-charge jet 40 triggers the transfer foil 10 at the location 41. Thereby, with regard to the hollow-charge jet 40, there come into action only the composite armorings 29 and 30 through the steel plate 13.3 and the glass plate 14. The hollow-charge jet 40 is already substantially weakened at a single effective steel plate 13.3.

Essential for the invention is the disruptive effect of the protective arrangement 19 which is maintained over a lengthy period of time. This effect is already sufficient for a hollow-charge jet 40 which enters into the lower chamber 9. The disruptive effect is at its maximum with regard to a hollow-charge jet which enters into the uppermost chamber 6, inasmuch as in this instance the steel plates 13 through 13.3 come into action.

The disruptive effect of the lower chamber 9 can be improved in that, additionally, one or two of the above-described composite or sandwiched armorings are mounted on the side plates 23 and 24.

The disruptive effect is principally achieved through respectively a single steel plate for each chamber 6 through 9 and a sequentially implemented triggering or detonating of the neighboring explosives foil 11 through 11.4 which are arranged in the chambers 6 through 9. As a result, there is again restarted the disruptive effect of the airborne plates 3, 13 through 13.3 after leaving the trajectory of the hollow-charge jet In this instance, there is present a continual and effective protection against tandem and dual-jet hollow charges. The glass plate 14 which faces towards the hollow-charge jet 20 evidences two advantages. Thus, it affords an essentially lower resistance to the hollow-charge jet 20 than does the steel plate 13, so that the detonating of the explosive foils 11 is rapidly carried out. On the other hand, it provides the countermeasure for the steel plate 13 which is to be accelerated in parallel.

In addition to the above-described rectangular configuration of the steel plates 3, 13 through 13.3, there can also be employed multi-cornered, circular, semi-circular or triangular shapes. Moreover, the composite armorings 26 through 30, instead of being at right angles to the base 2, can subtend a completely different angle.

The sequential detonations over a period of time can be controlled through delay charges which are arranged within the transfer foil 10. The number of the composite armorings, steel, explosives foils, glass can be increased in a suitable manner. The width of the composite armorings should be configured so as to avoid an excess of explosives from concurrently detonating. Individual protective arrangement 19 can be mounted adjacent to and also superimposed on each other. The transfer foil 10 can also be made discontinuous by means of apertures or slits.

The protective arrangement 19 is also effective against other types of ammunition. The cover plate 15 can be constructed to be so thick, that the applicable protective arrangement will not be triggered by any active bodies which are not dangerous to the main armor.

What is claimed is:

1. An arrangement for protection of an armored target from attack by hollow-charge projectiles fired against said target, comprising a composite reactive armoring including a wall of explosives arranged to extend obliquely facing oncoming projectiles, said wall of explosives being positioned behind a wall constituted from an inert material facing towards the oncoming projectiles, said composite reactive armoring including an explosives foil forming said wall of explosives, a steel plate covering one surface of said explosives foil, and said inert material wall forming a plate covering an opposite surface of said explosives foil, said composite armoring forming a plurality of chambers within a box structure such that respectively one said steel plate is positioned opposite one said inert material plate within each respective chamber of said plurality of chambers of said box structure; and the explosives foil in the opposite surface of said each respective chamber have bottom edges thereof interconnected by a transfer foil constituted from an explosive material.

2. A protective arrangement as claimed in claim 1, wherein the inert material wall plate of each chamber faces towards an oncoming jet from a hollow charge.

3. A protective arrangement as claimed in claim 1, wherein the transfer foil connecting the bottom edges of each said explosives foil covers a bottom surface of each chamber of said protective arrangement.

4. A protective arrangement as claimed in claim 3, wherein the transfer foil is pressed against to the internal bottom surface of each said chamber by a superimposed thin sheet of metallic material.

5. A protective arrangement as claimed in claim 4, wherein said metallic material consists of steel.

6. A protective arrangement as claimed in claim 4, wherein said metallic material consists of aluminum.

7. A protective arrangement as claimed in claim 1, wherein said inert material wall consists of glass.

8. A protective arrangement as claimed in claim 1, wherein said inert material wall consists of fiberglass-reinforced plastic.

* * * * *